US006442983B1

(12) United States Patent
Thomas et al.

(10) Patent No.: US 6,442,983 B1
(45) Date of Patent: Sep. 3, 2002

(54) DIGITAL ELECTRONIC LOCK

(76) Inventors: Michael Reed Thomas, 143 Highland Road West, Stoney Creek, Ontario (CA), L8J 2S7; Norman William Osborne, 18 Harold Street, Hamilton, Ontario (CA), L8P 2R6; Gaetano Nino Ricca, 304 John Street North, Hamilton, Ontario (CA), L8L 4P9

( * ) Notice: Subject to any disclaimer, the term of this patent is extended or adjusted under 35 U.S.C. 154(b) by 0 days.

(21) Appl. No.: 09/380,860

(22) PCT Filed: Mar. 5, 1998

(86) PCT No.: PCT/CA98/00165

§ 371 (c)(1),
(2), (4) Date: Nov. 18, 1999

(87) PCT Pub. No.: WO98/39538

PCT Pub. Date: Sep. 11, 1998

(30) Foreign Application Priority Data

Mar. 5, 1997 (CA) ..... 2199217

(51) Int. Cl.[7] ..... E05B 47/06; E05B 67/22

(52) U.S. Cl. ..... 70/38 A; 70/278.1; 70/386

(58) Field of Search ..... 70/277, 278.1, 70/278.7, 38 R, 38 A, 38 B, 38 C, 39, 386, 63

(56) References Cited

U.S. PATENT DOCUMENTS

| | | | | |
|---|---|---|---|---|
| 2,116,965 A | * | 5/1938 | Schoorel et al. | 70/38 A |
| 2,460,615 A | | 2/1949 | Andrew | |
| 4,609,780 A | | 9/1986 | Clark | 179/2 A |
| 4,838,052 A | * | 6/1989 | Williams et al. | 70/63 |
| 4,851,652 A | | 7/1989 | Imran | 235/382 |
| 4,864,115 A | | 9/1989 | Imran et al. | 235/492 |
| 4,901,545 A | | 2/1990 | Bacon et al. | 70/214 X |
| 5,189,893 A | * | 3/1993 | Kortenbrede | 70/38 A |
| 5,561,996 A | | 10/1996 | Chang | 70/247 |
| 5,791,172 A | | 8/1998 | Deighton et al. | 70/63 |
| 5,868,013 A | * | 2/1999 | Julien | 70/38 A |
| 6,043,733 A | * | 3/2000 | Lind | 70/237 X |
| 6,046,558 A | * | 4/2000 | Larson et al. | 70/283 X |
| 6,047,575 A | * | 4/2000 | Larson et al. | 70/278.1 |
| 6,236,307 B1 | * | 5/2001 | Kurano | 340/426 |

FOREIGN PATENT DOCUMENTS

| | | |
|---|---|---|
| WO | WO 90/15910 | 12/1990 |
| WO | WO 93/03246 | 2/1993 |

* cited by examiner

*Primary Examiner*—Lloyd A. Gall
(74) *Attorney, Agent, or Firm*—Vanophem & Vanophem, P.C.

(57) ABSTRACT

A lock which incorporates a digital programmable microprocessing interface capable of user-programming whereby a programmed combination opens the lock. According to one embodiment of the lock, there can be as many as approximately $10\times10^6$ possible different combinations which may be entered by the user. The operation of the lock is driven by an electric signal derived from the combination, and that electrical signal is sent to a motor assembly inside the lock body in response to which there is a disengagement of a set of locking balls from a locking bar, which with the assistance of a springing mechanism causes the locking device to open automatically.

25 Claims, 14 Drawing Sheets

DIGITAL ELECTRONIC LOCK

FIELD OF INVENTION

This invention relates to the security field and in particular concerns padlocks used in a variety of settings for maintaining the contents of receptacles in a secure fashion. More particularly, the invention relates to the use of a digital programmable microprocessing interface for the purposes of opening and securing a lock device.

BACKGROUND OF INVENTION

It is commonly known that when an individual is concerned about maintaining articles in a secure environment, people routinely use a variety of locking devices to secure receptacles wherein the material to be safeguarded is retained, such as, for example, safety deposit boxes and lockers. In such settings individuals utilize padlocks of either the key or combination variety on the latches of these containers so as to maintain the contents in a secure fashion. Standard padlocks widely available today consist of three basic types: 1) A standard key lock which operates on the basis of a tumbler system and is actuated by inserting a key into a cylinder at the base of the lock which contains pins or mechanical devices which release a locking bar mechanism when the key is turned. In such padlocks, release of the locking bar mechanism when the key is turned. In such padlocks, release of the locking bar is assisted by a spring; 2) A standard combination padlock which is operated by rotating a numbered dial on the front of such lock body. Attached to the dial internally, is a series of disks which have stops and open gaps cut out such that they are aligned to all be in the same open position by rotation of the dial in both directions based upon a pre-programmed set of numbers derived from a factory which produces the lock. According to this type of lock, once the aforementioned spaces are aligned in the open position, the lock can be opened by pulling down on the lock body; and 3) A standard combination padlock which is operated by turning a series of numbered tumblers to a pre-set combination which aligns gaps in a locking bar to an open position. Once this open position is achieved, the lock is free to disengage when the lock body is pulled away from the locking bar. These types of locks have been available for a considerable period of time. However, unless the user has the key or is able to remember the factory-provided combination, it is not possible to open these locks. Further, it is not possible to change the method by which these locks may be opened. Additionally, it is possible for key tumbler locks to be "picked" open and combination dial locks are susceptible to opening if the tumbler action can be heard, typically with the assistance of an aid for amplifying hearing.

In response to the foregoing and other problems, various electronic locks and lock-boxes incorporating padlocks have been developed. One example of an electronic door lock is "Self-Contained Electromechanical Locking Device", U.S. Pat. No. 4,901,545 to Bacon, which teaches an electromechanical lock incorporated into a doorknob for use on an original installation of a door lockset, or for retrofitting onto an existing door lockset. The lock in Bacon is characterized by a doorknob having the usual key-cylinder and tumbler mechanism. Additionally, Bacon comprises a keypad mounted on the top of the doorknob and connected to a computer controller housed within the knob. In turn, the controller is operably connected to a motor also housed within the knob. The motor moves a locking pin, which resides within an aperture adjacent the tumbler mechanism, between a locked and unlocked position. (See Item 65, FIG. 6 and Col. 5, Line 62-Col 6, Line 18). When a correct key-code is entered, the locking pin moves out of engagement with the tumbler mechanism, thereby allowing a key or a turn-key to turn in the key-hole and thus open the lock. Unfortunately, the mechanical linkage of the motor to the tumbler mechanism requires a bulky housing, which is suitable for a door lockset but unsuitable for a padlock, and the small locking pin in Bacon is unsuitable for securing a shackle in a padlock. Further, the lock in Bacon essentially has a two-stage unlocking procedure; first, the key-code must be entered, and second, the key must be turned within the lockset. This two-stage procedure saves battery life by reducing power consumption, but is thus unsuitable for a lock with a one-stage unlocking procedure.

Another example of a lock is found in "Gearshift Lock", U.S. Pat. No. 5,561,996 to Chang, which teaches a large padlock that prevents a gearshift from moving out of the park position, thereby preventing theft of the vehicle. The lock in Chang incorporates a lock box having two parallel passages to receive each end of a U-shaped shackle. The shackle has a recess on each end for locking engagement with the box. The lock box incorporates a locking mechanism which engages the recesses when the shackle is inserted within the passages. The locking mechanism embodies a motor having a pinion gear on its output shaft. The top of the pinion gear engages an upper rack gear, while the bottom of the pinion gear engages a lower rack gear. Each rack gear is "L" shaped, having a bar mounted perpendicularly on their ends. The rack gears are biased away from each other by a pair of springs, which drive the bars into the recesses. A mechanical key is used to activate a switch to drive the motor in a reverse (unlocking direction) which compresses the springs and urges the rack gears together. The motor is powered by the vehicle battery. It will be apparent to those of skill in the art that the rack gears and springs must be of a sufficient size to resist attempts to break the lock and, accordingly, a relatively large motor and power supply is required to generate sufficient torque to compress the springs and move the rack gears.

When driven in the reverse direction, the upper and lower rack gears are driven inwards, thus disengaging the bars from the recesses, thereby releasing the shackle from the lock box. While the lock in Chang is suitable for a large gearshift lock having an external power source, it is unsuitable for a small padlock requiring a self-contained power supply. Further, the lock in Chang requires the use of a key, and cannot be operated by simply entering a combination or key-code.

"Electronic Access Card Having Key Pads and Coils and Combination Using the Same", U.S. Pat. No. 4,864,115 to Imran and Clark, teaches an electronic access card that can be used to operate real estate agent lock boxes which retain a door key. Such boxes are typically combined with a padlock for securing the box to a doorknob, and are used to give several real estate agents access to a single door key of a dwelling, by affixing the lock box to an outside door of the dwelling. The access card contains a power supply and a plurality of programming features to allow the card to open multiple lock boxes, and to record and limit access time to the lock boxes.

"Electronic Lock Box, Access Card, System and Method", U.S. Pat. No. 4,851,652 to Imran, teaches a type of real estate agent lock box for retaining a door key combined with a padlock for securing the box to a doorknob. Imran includes an external electronic key, which houses a power supply for operating both the lock box and the padlock. Electromagnetic solenoids are used to move leaf springs to open the lock box and the padlock. It will be apparent to those of skill in the art that springs of sufficient size must be used in order to keep the box secured.

"Improved Electronic Security System", WO 93/03246 to Babler, teaches an electronic lock box for storing a mechanical key combined with a padlock for affixing the box to a doorknob. The lock box has a nest on its exterior to receive an electronic key. The lock box further includes an interior computer, an internal locking mechanism for the lock box, and an internal locking mechanism for the padlock. The padlock locking mechanism within the lock box includes a solenoid having a pair of plungers which are spring biased in an outward position to engage the shackle, and can be retracted by an electromagnetic winding within the solenoid to release the shackle.

The external electronic key has a keypad, a computer and a power supply to power both the electronic key and the lock box. To use the electronic key, it is inserted into the nest at which point the computer in the keypad communicates with the keypad in the lock box to establish a combination. At this point the real estate agent can use the keypad to enter a combination to either open the lock box or the shackle. The power to engage and disengage the locking mechanism is provided by batteries located within the external electronic key. While Babler is well suited to the needs of real estate agents, the lock box in Babler is not suitable for use as a simple padlock as the power supply and electronic key are not self-contained within the lock box. Furthermore, the combination of the lock box is not programmable within a self-contained unit.

"Electronically Controlled Security Container for Retaining Door Key", U.S. Pat. No. 5,791,172 to Deighton, teaches another type of real-estate electronic lock box combined with a padlock. The padlock shackle has a notched arm which engages a fork member pivotally mounted on the container chassis. The fork member is urged by a spring in a direction for disengagement but is retained in engagement by a cam which engages a second tapered wheel connected to the motor gear train. When the motor is driven in a certain direction, the cam is driven along the wheel and finally off the end thereof, permitting the fork to be driven out of engagement with the shackle arm. It will be apparent that the padlock in Deighton is not intended to secure a door shut, but only to retain the lock box on a door handle and, accordingly, in order to adapt Deighton for use as a padlock, a sufficiently large spring biasing device would be necessary to adequately secure the shackle. This is disadvantageous, because a large spring would require a larger motor and self-contained power supply in order to operate the lock. Deighton also incorporates an infrared key and lock actuation system, which is disadvantageous as the key could be lost.

"Electronic Secure Entry System Apparatus and Method", U.S. Pat. No. 4,609,780 to Clark, teaches another type of real-estate electronic lock box combined with a padlock. A notched shackle having a spring-biased latching member normally engaging the notch can be retracted from the notch with an electromagnetic solenoid, thereby releasing the shackle. A keypad connected to an electronic control board engages the solenoid when the correct keycode is entered into the keypad. However, similar to other prior art, the latching member must be sufficiently sized to prevent the shackle from opening thereby necessitating a larger spring and solenoid, and thus requiring the lock box to be of sufficient size to house the entire mechanism and power supply.

"Electronic Lock", WO 90/15910 to Symons, teaches an electronic lock having a notched shackle engaged by a pair of rods spring-biased outwardly to engage the notches. An electromagnetic solenoid can be activated to retract the rods inwardly, thereby releasing the shackle. Symons has the same disadvantages as other prior art, namely that a spring of sufficient size must be used to ensure the rods securely engage the shackle, thereby necessitating a sufficiently large solenoid and power supply to overcome the force of the springs.

"Locking Devices", GB 2 144 483 A to Miller et al., teaches two embodiments of an electronic padlock, both of which incorporate a rod which is spring biased to engage a recess in the shackle. Miller incorporates a solenoid or winding to compress the spring and retract the rod from the recess in the shackle. Unfortunately, the use of a spring necessitates a sufficiently sized power supply and solenoid to overcome the force of the spring. Accordingly, the power supply in Miller is external to the padlock, and is incorporated into an external key-device. Further, due to the constraints of batteries, this padlock is not suitable to a key-less, self-contained padlock having a long battery life between battery changes. Finally, the use of solenoids necessitates a shorting bridge to prevent false actuation by a powerful external magnet.

SUMMARY OF THE INVENTION

The present invention overcomes the aforementioned deficits in lock technology by providing a lock which incorporates a digital programmable microprocessing interface capable of user-programming and wherein a programmed combination opens the lock. According to one embodiment of a lock of the present invention there can be as many as approximately $10\times10^6$ possible different combinations which may be entered by the user.

According to a further embodiment of a lock of the present invention, operation of the lock is driven by an electric signal derived from a combination which is entered by a user where the electric signal is sent to a motor assembly inside the lock body. A motor assembly of the lock in response to the signal, disengages a set of locking balls from a locking bar or other appropriate device for disengaging a locking mechanism of this invention. With the assistance of a springing mechanism, the locking device opens automatically.

According to a further embodiment of a lock of this invention, there is provided a sensor switch wherein depression of a locking bar to achieve a closed position provides a pulse to a motor assembly which engages a locking mechanism in order to secure the lock in a locked position. At this time, according to this embodiment of the invention, an electronic interface is reset to a ready position and cannot be opened except by reinserting a prearranged code.

According to yet a further embodiment of a lock of this invention, an electric signal of the lock is generated by battery power or other suitable portable energy-providing source.

Further features and advantages of the invention will be apparent from a reading of the detailed description of the invention taken in conjunction with the appended drawings.

DESCRIPTION OF THE INVENTION

Figure 1:
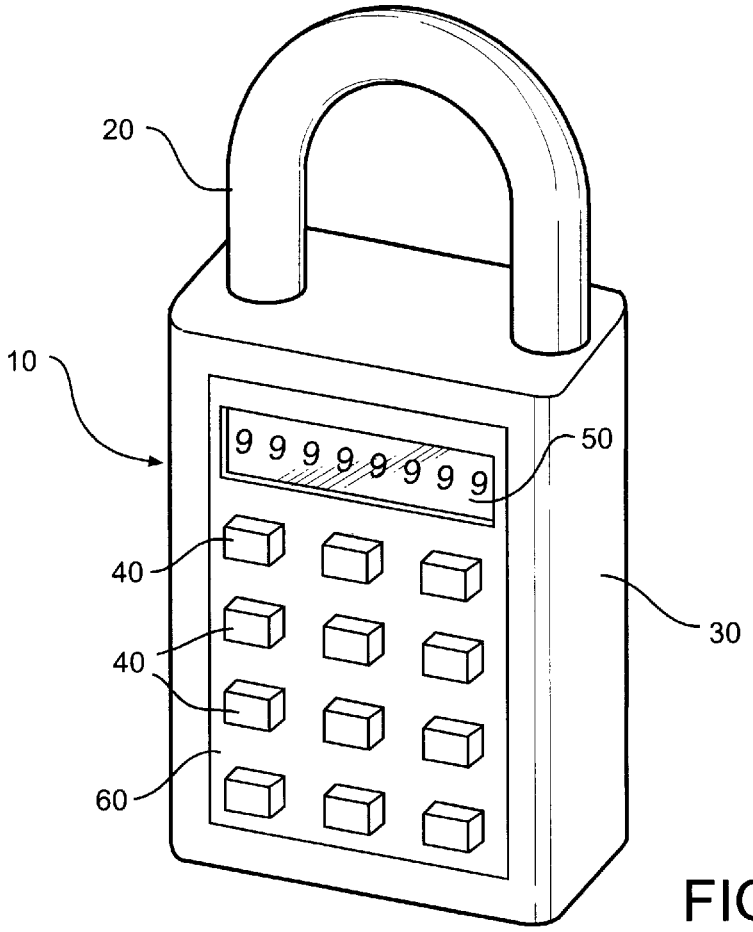
FIG. 1 is a perspective view of a complete lock of the present invention.

Referring now to FIG. 1, a preferred embodiment of the lock of the present invention is illustrated at 10. The most significant exterior components are a locking bar or shackle 20, a main body 30, a keypad 40 made of plastic or other suitable materials and a front cover 60 which provides access to a control module board and which retains the keypad in position. It also provides a place for a liquid crystal display (LCD or LED display) 50. Referring now to the remaining figures, the parts of this preferred embodiment will be described in greater detail. A summary of how the fully integrated lock operates will be provided following the detailed description of the parts.

Figure 2A:
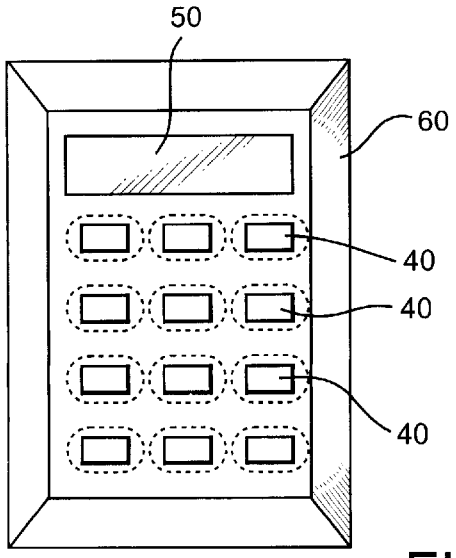
FIG. 2A is a front view of the front cover of the lock unit of FIG. 1.

Turning now to FIG. 2A, a space for the liquid crystal display 50 is provided on the front cover 60. The front cover provides a housing for the keypad 40, the liquid crystal display 50 and a control module (not shown, however, see FIG. 11). The front cover is molded such that a lip 80 (FIG. 2B) protrudes allowing for a tight fit between the main body 30 of the lock 10 and the front cover 60.

Figure 2B:
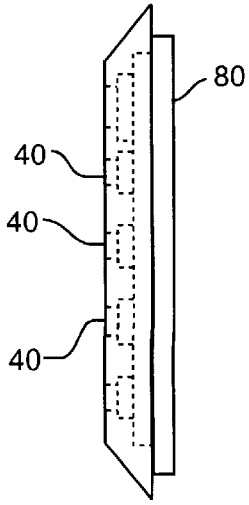
FIG. 2B is a side view of the front cover of FIG. 2A.

This lip may be better seen in FIG. 2B which provides a side view of the front cover of FIG. 2A.

Figure 3A:
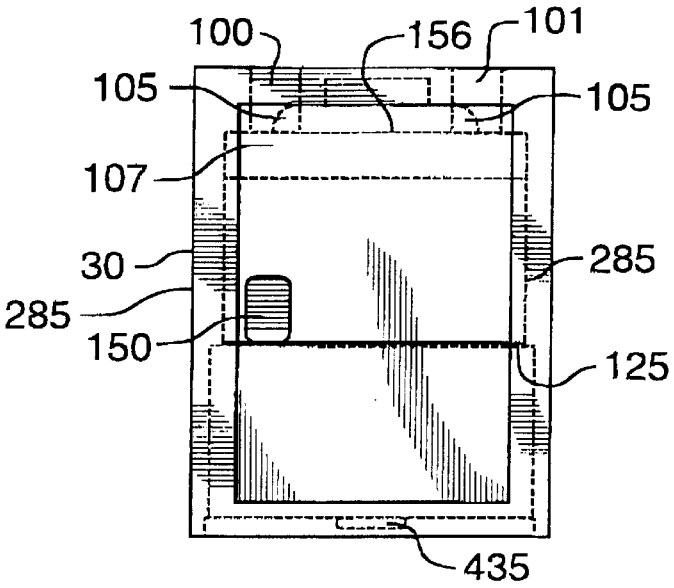
FIG. 3A is a front view of the main body of the lock of FIG. 1.
Figure 4A:
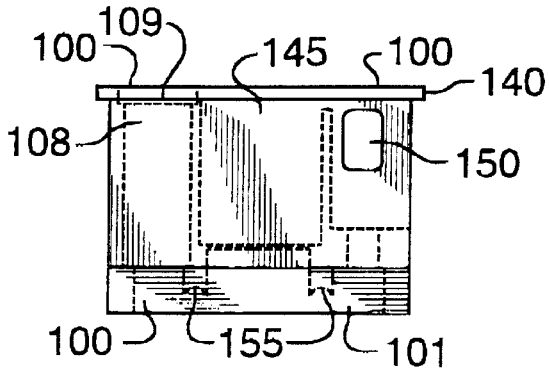
FIG. 4A is a front view of the body insert for positioning in the main body illustrated in FIG. 3A.

Turning now to FIG. 3A, a front view of the main body is provided and illustrates the location for the components within the main body of the lock. The insert (illustrated in FIGS. 4A and 4B) is located in the space 120 and a standard 9 volt battery resides in the space 110. The shackle or locking bar 20 exits and returns to the main body through spaces provided at 100 and 101. As illustrated, the insert of FIG. 4A is rotated 180° and pressed up into the main body 30 of FIG. 3A. Once in this position it can be seen that in the locked position two steel ball bearings (not shown) residing in the cavities formed between 105 and 155 are brought together.

Figure 4B:
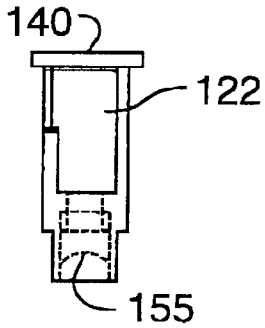
FIG. 4B is a side view of the body insert of FIG. 4A.
Figure 17:
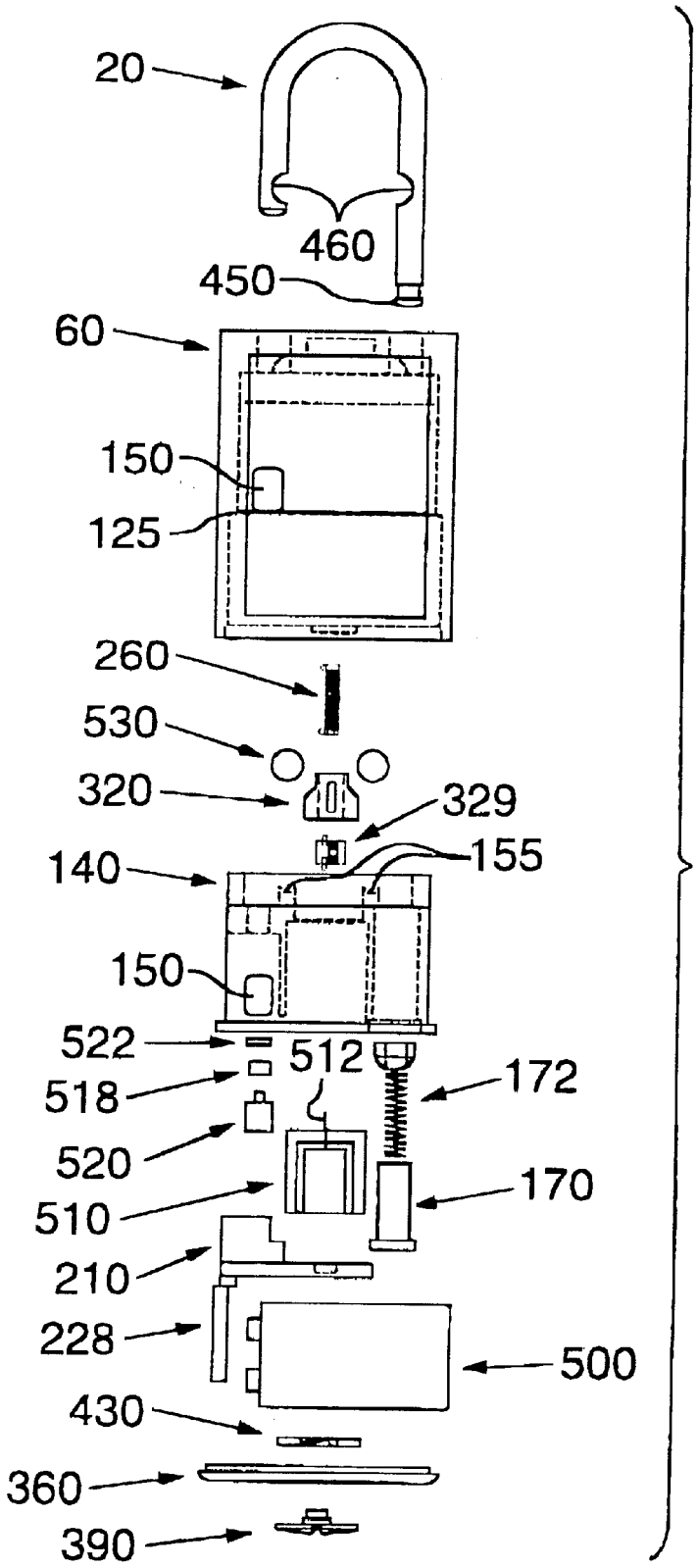
FIG. 17 provides an exploded view of the lock of FIG. 1.
Figure 18:
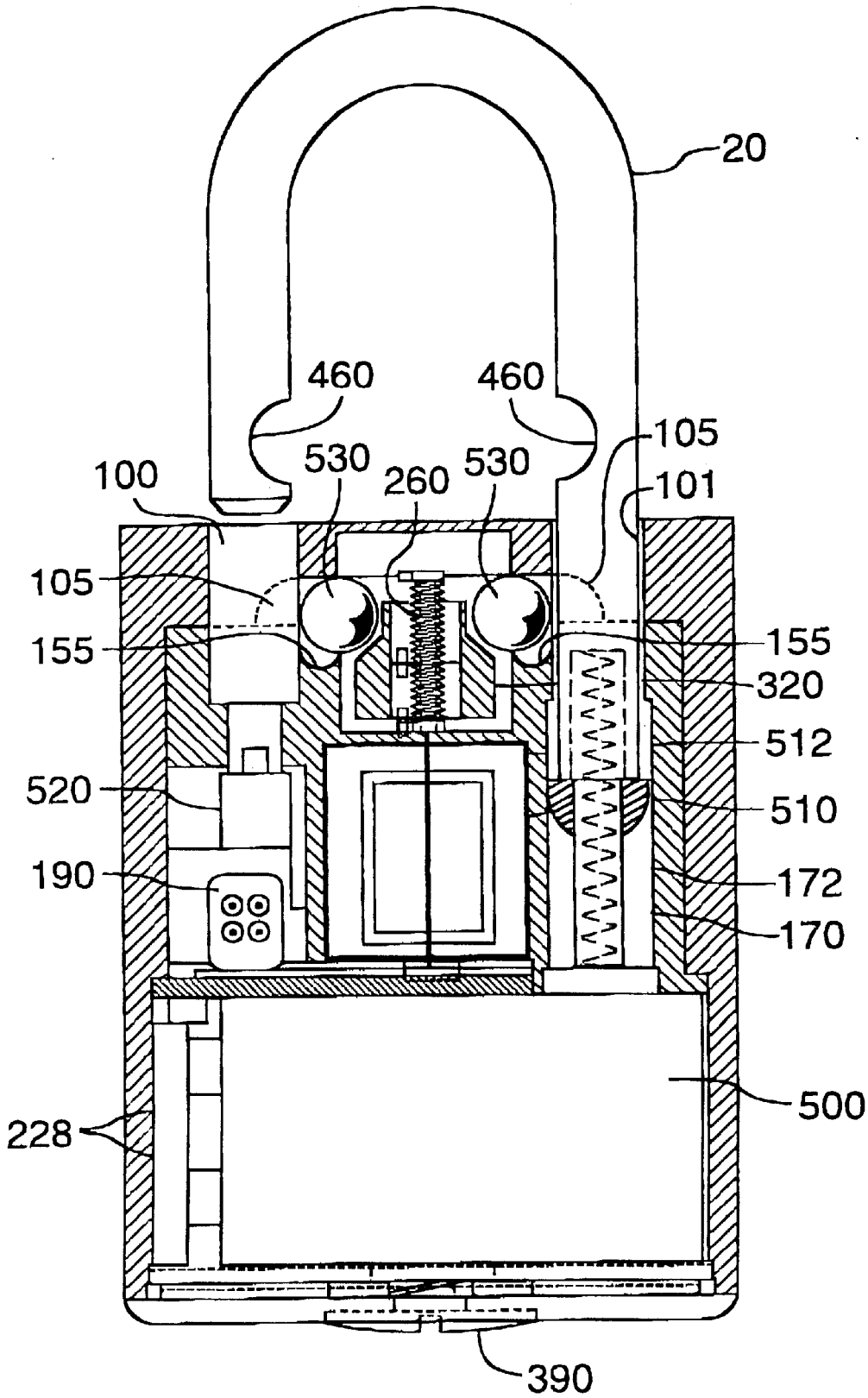
FIG. 18 illustrates an assembled view of the lock of FIG. 1 without the front cover.

Referring now to FIGS. 4A and 4B, the insert resides in the main body 30 illustrated in FIG. 3A, with the lip 140 (FIGS. 4A and 4B) resting against the shoulder 125 (FIG. 3A). A cutout section 150 provides a space for the contact pins of the interface to be inserted into the wiring insert illustrated in FIGS. 6A, B and C which resides inside the body insert of FIGS. 4A and B at location 122. By virtue of the wiring insert of FIGS. 6A, B and C, an electrical interface is made between: 1. the battery 500; 2. the motor 510; and 3. the re-locking switch 520. This is well illustrated in FIGS. 17 and 18. As mentioned above, the lower half of two cavities is formed by 155, which when assembled in conjunction with cavity 105, retains the steel balls.

Figure 3B:
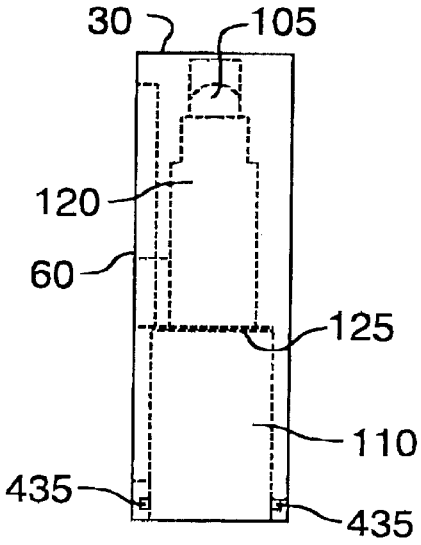
FIG. 3B is a side view of the main body of FIG. 3A.
Figure 5A:
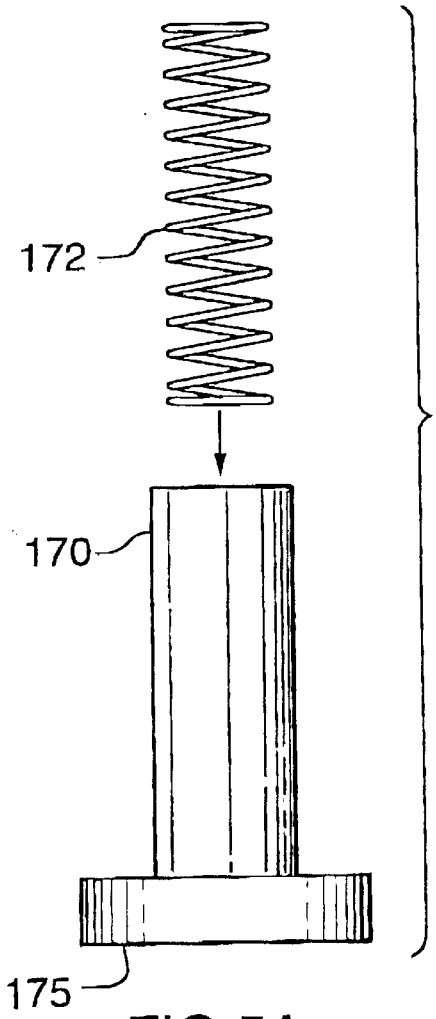
FIG. 5A is a side view of a spring retainer and spring.
Figure 5B:
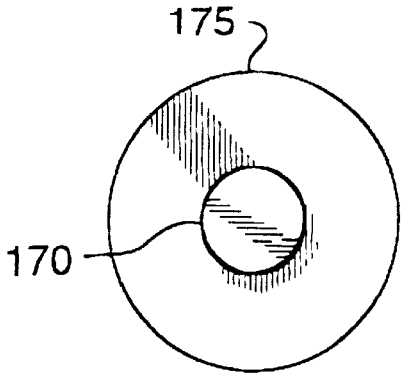
FIG. 5B is a top view of the spring retainer of FIG. 5A.
Figure 6A:
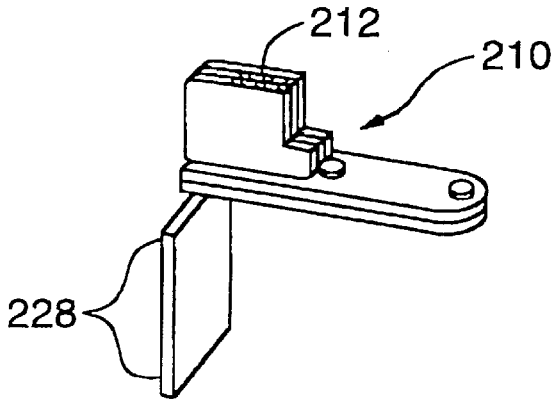
FIG. 6A is a perspective view of a cast wiring insert which is pressed to fit into the body insert of FIG. 4A.
Figure 6B:
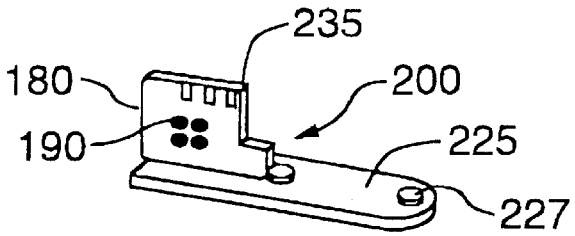
FIG. 6B is a perspective view of a plastic assembled wiring insert for use with the cast wiring insert of FIG. 6A.
Figure 6C:
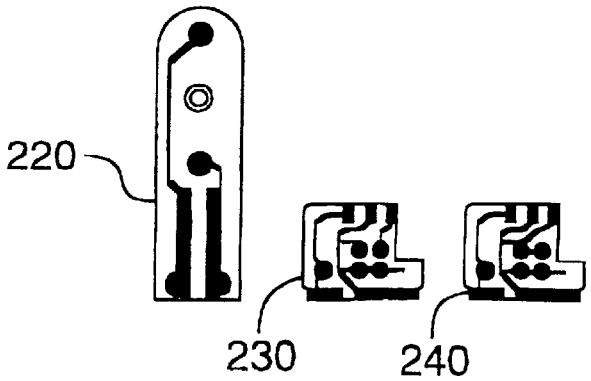
FIG. 6C illustrates wiring insert components of the assembly of FIGS. 6A and 6B.
Figure 16:
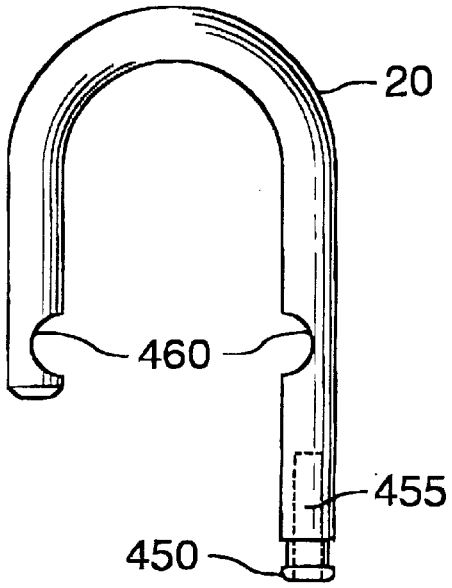
FIG. 16 illustrates a shackle or locking bar of the lock of FIG. 1.

When the insert of FIGS. 4A and 4B is pressed into the main body 30 shown in FIGS. 3A and 3B a tubular cavity hole 108 becomes aligned with the space 100. The free portion of the locking bar or shackle 20 is inserted through the space 100. Into the base of the shackle 20 is attached a split retaining ring not shown. Into the space 455 shown in FIG. 16, is inserted a spring 172. A stem 170 of the spring retainer shown in detail in FIGS. 5A and 5B is passed through the space 455. A base 175 of the spring retainer is pressed into a recessed hole 109 illustrated in FIG. 4A to apply pressure through spring tension to open the shackle. The tension of this spring may be adjusted through variation in length to either assist or completely open the shackle when the shackle is released upon opening. Referring to FIGS. 6A, B and C, the cast wiring insert is shown in detail. An arm 225 extends across the bottom of the insert shown in FIGS. 4A and B and the contacts 227 (see FIG. 6B) form the electrical circuit to the motor 510 which resides in a cavity 145 (FIG. 4A). When the wiring insert is in position, four wiring interface receptacles 190 which reside on the connections 230 and 240 which make up 180 shown in FIG. 6B are electrically connected to the circuit logic board through the connections 230 and 240 shown in FIG. 6C and are located in the window of the insert 150 (see FIG. 4A).

At position 212 of the insert (FIG. 6A) there is located the reversing or locking switch 520. This switch 520 may be seen in FIG. 17. When the insert of FIGS. 4A and B is assembled in the main body 30 (FIGS. 3A and B) the switch 520 locates to position 107. Above the switch 520 is a ferrule 518 and above this is a rubber diaphragm 522 (see FIG. 17). When the lock is being closed pressure on the shackle 20 depresses the switch 520 which reverses the motor 510 which re-engages balls 530 in shackle recesses 460.

An extension 228 of the wiring insert illustrated in FIG. 6A rests against the wall of the front cover 60 (see FIG. 3B) in the space or battery compartment 110. It has two contacts which connect with a 9 volt battery to the electrical circuits through the wiring insert.

Figure 7A:
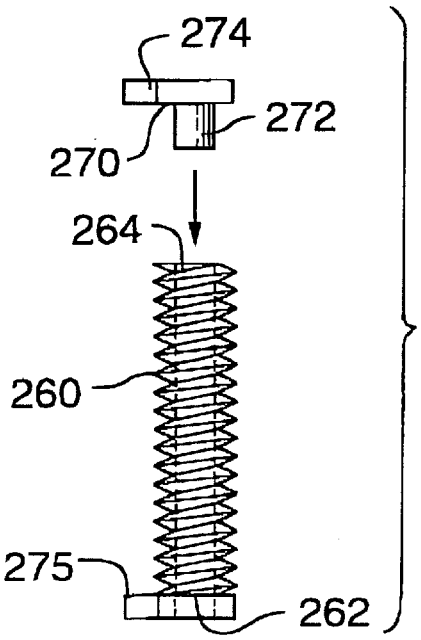
FIG. 7A is a side view of an actuating screw and press fit insert.
Figure 7B:
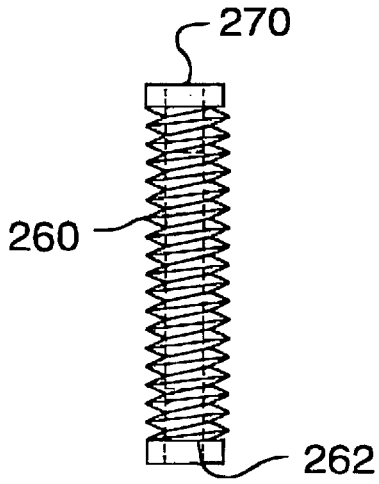
FIG. 7B is a side view of the actuating screw of 7A with the press fit insert in position.
Figure 9A:
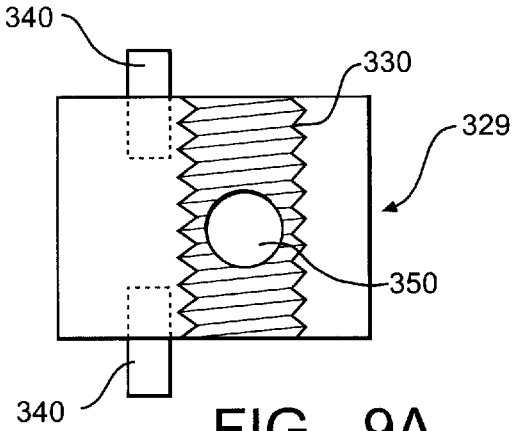
FIG. 9A is a view of a wedge-actuator according to the present invention.
Figure 9B:
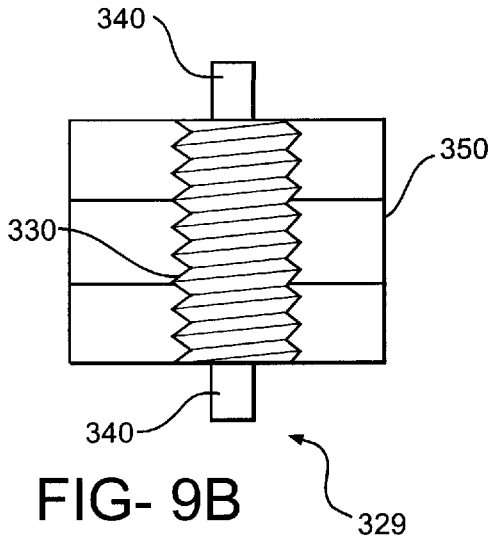
FIG. 9B is a side view of the wedge-actuator of FIG. 9A with actuator pins inserted in the top and bottom of the wedge-actuator.
Figure 9C:
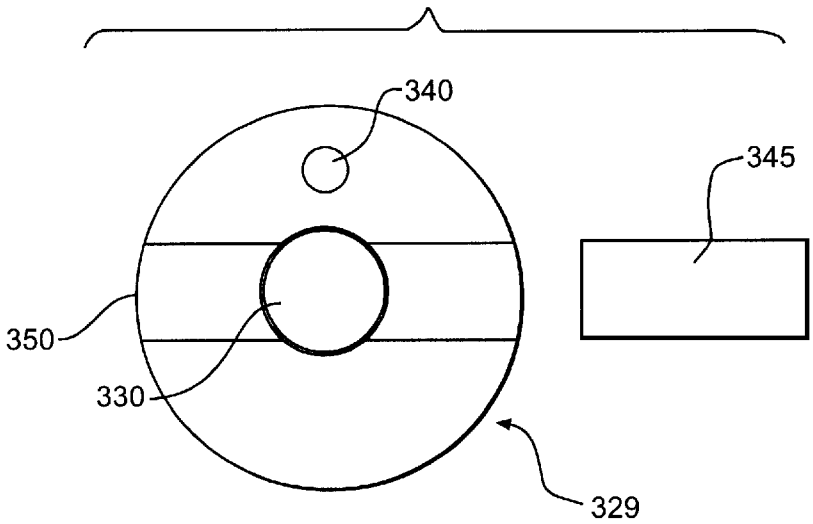
FIG. 9C is a top view of the wedge-actuator of FIG. 9A disclosing the position of the actuator pins.

Referring to FIG. 7A there is illustrated an actuating screw 260. A hole 262 in the screw is of such dimensions that it is a "press fit" on a motor shaft 512 of the motor 510 (see FIG. 17). Onto the screw is threaded a wedge-actuator which is illustrated in detail in FIGS. 9A, B and C. A cap 270 (FIG. 7A) has a stud 272 of such diameter that it presses into a hole 264 of the actuating screw. The stud is aligned as shown in FIG. 7B. Referring to FIGS. 9A, B and C, the wedge-actuator 329 contains two studs 340 which restrict the travel of the wedge-actuator at the end of the actuating screw (FIG. 7A) by engaging lugs 275 at one end and 274 at the other. These act as an anti-locking device so as to maintain the assembly in a free running configuration.

Figure 8A:
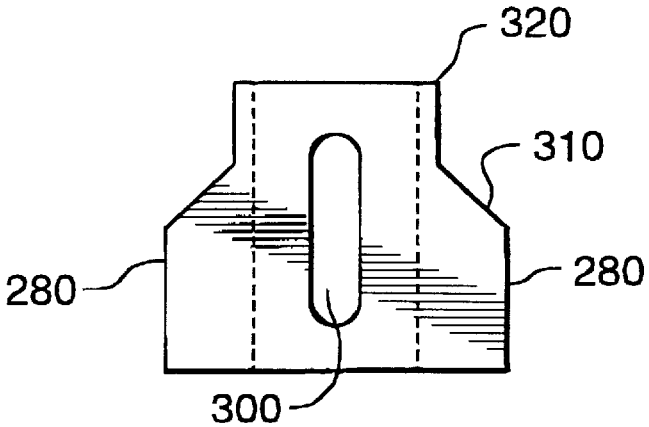
FIG. 8A is a side view of a locking wedge of the lock of FIG. 1.
Figure 8B:
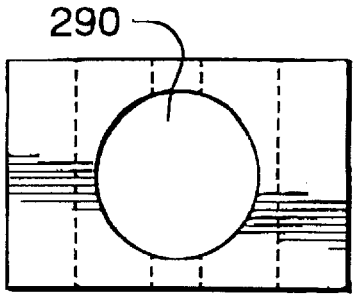
FIG. 8B is a top view of the locking wedge of FIG. 8A.

A locking wedge 320 of FIGS. 8A and B fits onto the wedge-actuator 329 (FIGS. 9A, B and C) placing the wedge-actuator 329 inside the locking wedge 320 through a hole 290 of the locking wedge 320. A small stud or pin 345 is pressed into a hole 350 in the wedge-actuator 329 through a slot 300 in the locking wedge 320. The pin stops the wedge-actuator 329 from rotating with the screw, and the slot 300 in the locking wedge 320 allows the motor 510 to gain sufficient speed to engage and disengage the locking wedge 320.

This assembly is situated in the cavity found at location 156 which is illustrated in FIG. 3A. When locked, the two steel balls reside in positions 105, one on each side of the locking wedge 320. The balls are moved up to engage the shackle 20 by virtue of shoulders 310 on the locking wedge 320 when it is driven up by the motor 510.

Figure 10:
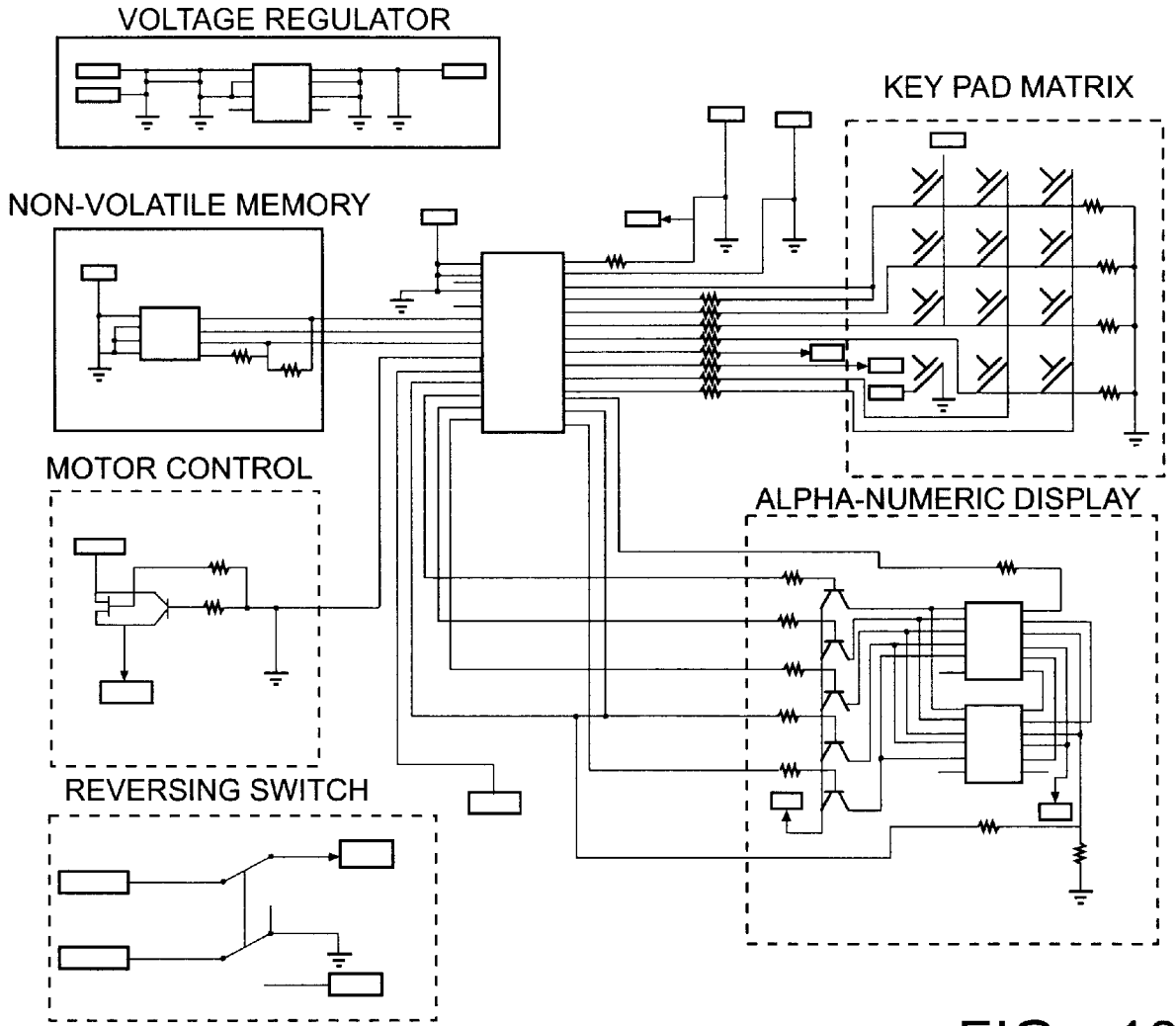
FIG. 10 illustrates a controller board for use in the lock of FIG. 1.

The electronic control board which provides the user with an ability to activate the lock is disclosed in FIG. 10.

Figure 11:
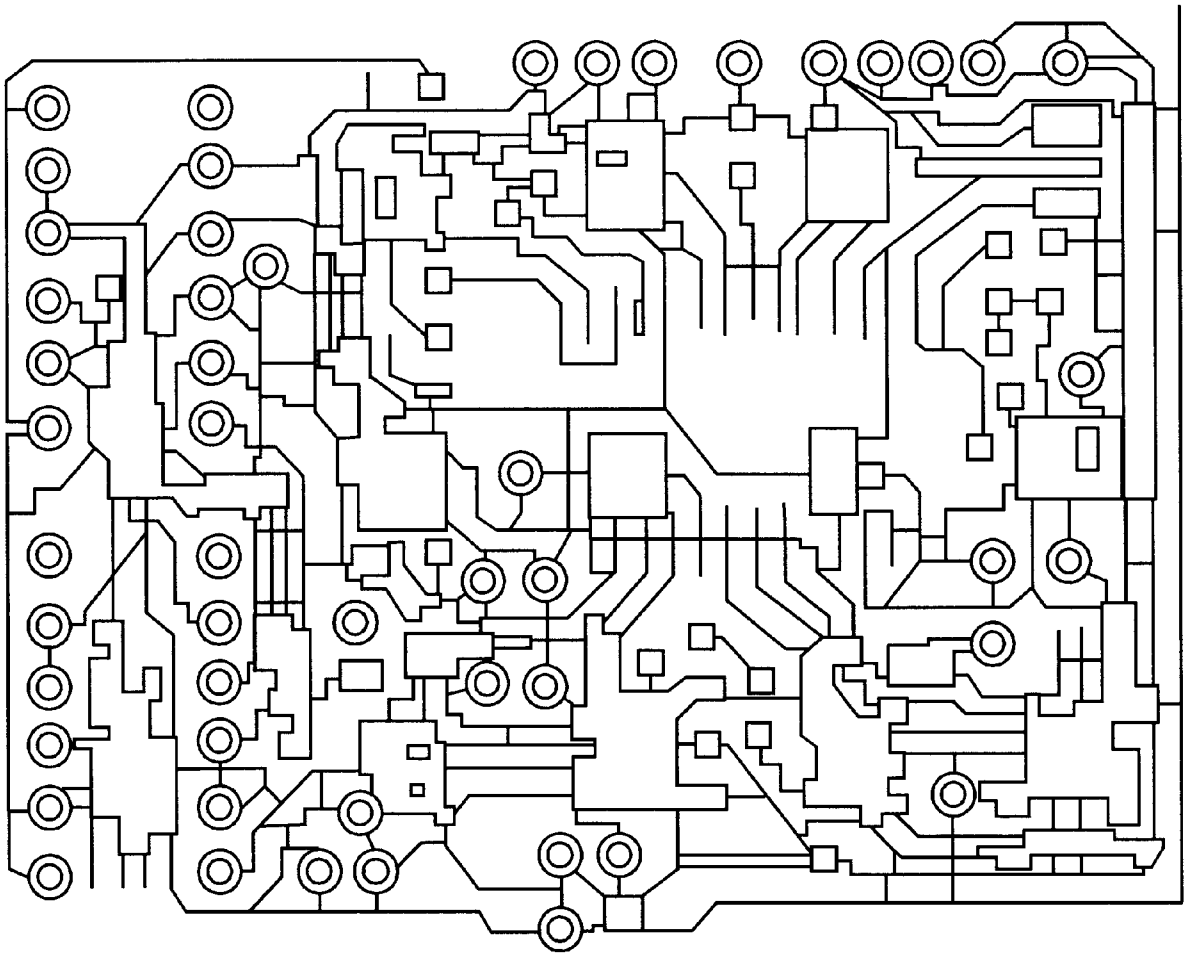
FIG. 11 illustrates a control module of the controller board of FIG. 10.
Figure 12A:
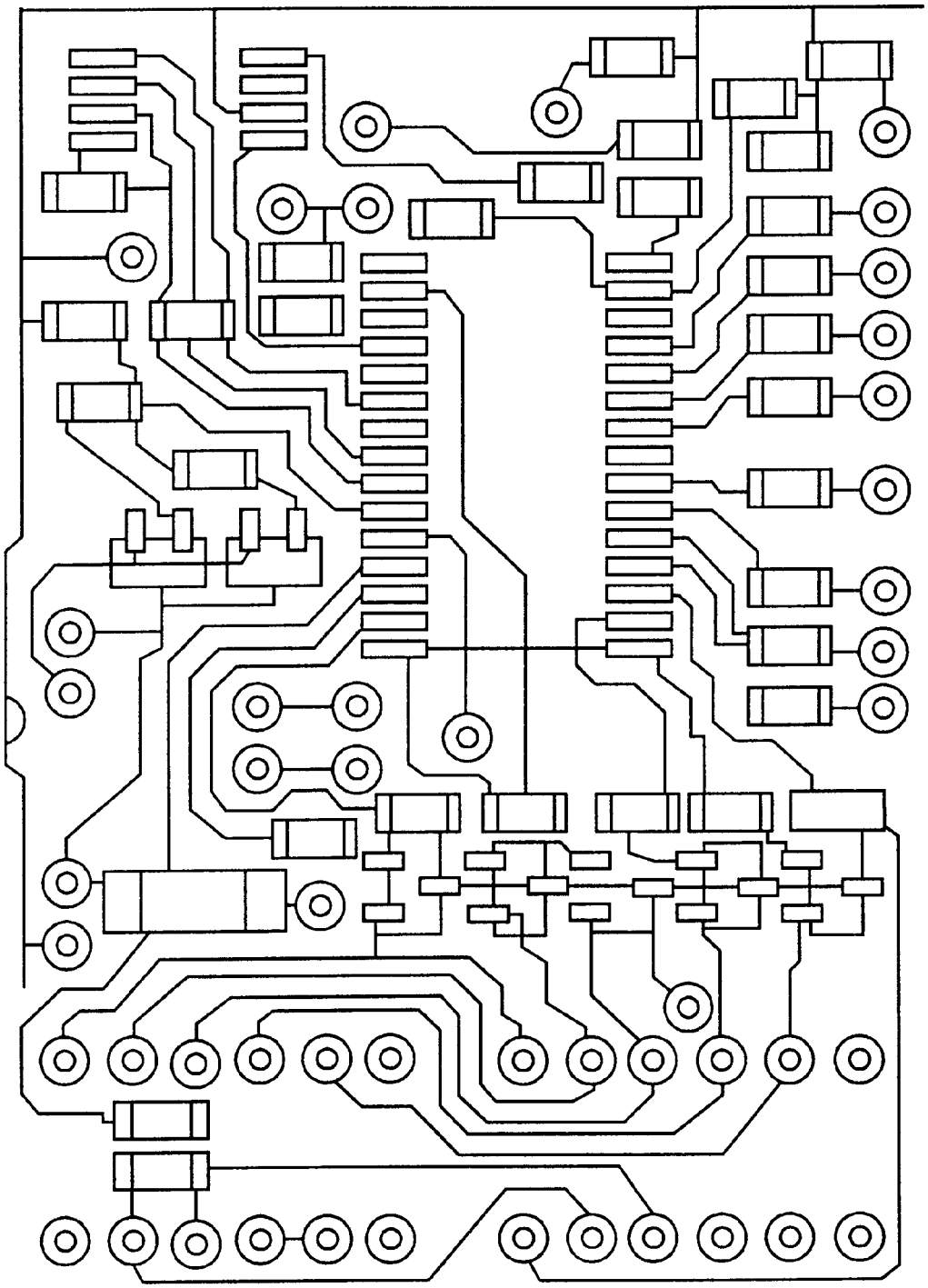
FIG. 12A provides an expanded view of the solder side of the control module of FIG. 11.
Figure 12B:
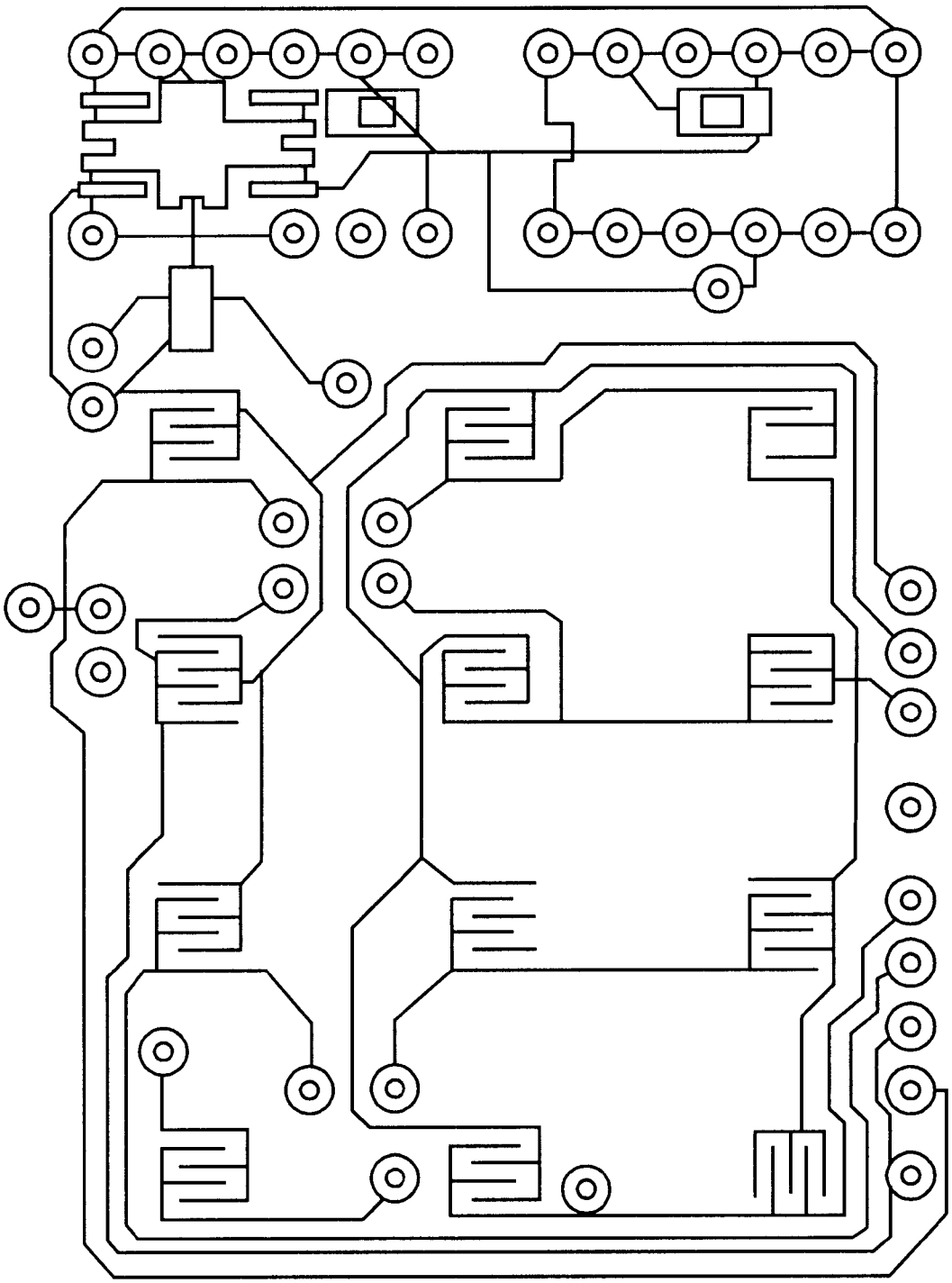
FIG. 12B illustrates the component side of the control module of FIG. 11.

A further view of the control module is provided in FIGS. 11 and 12A and 12B. The parts required for this microcontroller are well known in the industry and include standard resistors and regulators, diodes and transistors. A brief description of the materials required is included on Table 1.

TABLE 1

| Qty | Ref | Description | MFG | Part No. |
|---|---|---|---|---|
| 1 | 16C57 | PIC16C57 Microcontroller | Microchip | PIC16C57-SO-RC |
| 2 | HDSP2003LP | HDSP200X Smart Led Display Driver | Hewlet Packard | HDSP2003LP |
| 1 | 93LC46 | IC2 Serial Eeprom 8 × 128 bit, SO-8 Case | Microchip | 93LC46-SO |
| 1 | M7805ACM | 5 Volt Regulator, SO-8 Case | Motorola | M7805ACM |
| 1 | 47 k | 47,000 Ohm Resistor, 5%, 805 | Any | |
| 7 | 10 k | 10,000 Ohm Resistor, 5%, 805 | Any | |
| 1 | 47 k | 47,000 Ohm Resistor, 5%, 805 | Any | |
| 13 | 1 k | 1,000 Ohm Resistor, 5%, 805 | Any | |
| 2 | 220 R | 220 Ohm Resistor, 5%, 805 | Any | |
| 4 | 100 R | 100 Ohm Resistor, 5%, 805 | Any | |
| 6 | 0.1 uf | 0.1 Mfd, SMT, 805, 16 V | Any | |
| 1 | 220 pf | 220 Pfd, SMT, 805, 16 V | Any | |
| 1 | IN4004 | IN4004 Diode, SMT, DO-14 Case | Any | |
| 7 | 2N3904 | 2N3904 NPN Transistor, SOT-23 Case | Motorola | MMBT3904 |

The electronic control board has five sections. Four of the five sections are responsible for a specific function and are controlled by the fifth section, the main processing unit (PIC16C57-RC). The four function specific sections are as follows: 1) a non-volatile memory; 2) a motor control; 3) a keypad matrix; and 4) the alpha-numeric display. All five sections are further described below.

The microprocessor is a microchip PIC16C57-RC which contains an 8-bit programmable processing core. The PIC16C57 is capable of high speed instruction rates, (5 million per second), and little external hardware is required to support the chip, resulting in a low cost package. All interface and control are handled directly through the available input/output (I/O) lines. The I/O lines are internally diode clamped to prevent damage from stray transient voltages. The PIC16C57 is also a CMOS device with typical current requirement of as little as 15 microamps in power down mode, thus making it suitable for battery powered devices such as the present invention.

The non-volatile memory section consists of a microchip 93LC46 serial eeprom (128×8-bit). The 93LC46 is also a CMOS device with low power consumption characteristics, and is typically capable of over 1,000,000 write and erase cycles, and is pin compatible with other eeprom devices at densities of up to 64,000 bit (8,000×8-bit). As installed in the present invention, the eeprom retains the combination code to unlatch the lock. It can be set up to retain upwards of 128 to 8,000 individual codes (depending upon eeprom chip), with no loss of data at power down such as occurs upon battery removal.

The motor control section consists of a pair of transistors configured as current amplifiers. The processor motor control I/O state is amplified and fed to the DC motor 510 (FIG. 17) to control motor on/off state.

The keypad matrix provides the user interface to the processor. It accepts user keystroke commands and relays them to the processor. The keypad consists of conductive rubber buttons which make contact with pads on the printed circuit board, and allow a current through to the processor I/O lines. The processor decodes the keypad data into commands which it then executes.

The alpha numeric display is a 5×7 LED matrix, 8 characters in width, it displays the current processor state, entered code and activity. It can also be replaced by a lower power consumption liquid crystal display (LCD), or a non alpha indicator state display (e.g. lamps, LEDS etc. . . . ). In a preferred embodiment of the lock of the present invention, the configuration on the display is a standard alpha numeric ASCII display terminal supporting full terminal emulation.

PROGRAM LOGIC CONTROL

The sequence and program flow for the configuration of the embodiment of the lock as described herein is as follows. The processor, on startup, searches the eeprom to ascertain if a combination code had been previously entered. If the eeprom does not find a stored combination, the eeprom is erased and verified to be blank, the motor is engaged to unlatch the locking bar, and the display provides a "NO PROGRAM" message. The user then depresses the "Enter" key by use of the keypad 40 (see FIG. 1) to signify the start of the programming cycle. At this time, the display 50 provides a "PROGRAM" message which serves as verification that the processor has entered the programming state. Once the programming state has been reached, the user can enter any code combination from 0 to 8 characters in length. These characters are correspondingly displayed in the order of input. When the code input is complete, the user then presses the "Enter" button which signifies the end of the program cycle and that the data is correct. The processor then enters a verification state, and the display provides a "VERIFY" message. At this time the user must then re-enter the combination code to verify that the data is correct before the code is down loaded to the eeprom for storage. If at any time during the programming cycle the "reset" button is depressed, code verification fails, or the processor "times out", the eeprom is wiped out and the "newlock" or "NO PROGRAM" state is initialized until reprogrammed.

If a combination code has been previously entered, the processor displays a "READY" message. If the combination code then entered by the user does not match the previously programmed code, the display signifies this by displaying an "ERROR" message. If the code matches the previously programmed code, the motor is engaged to unlatch the locking bar and upon successful completion of "unlatch", the display provides an "OPEN" message. If the user at this time wishes to modify or eliminate the stored code with the display providing the "OPEN" message, the user must depress the "0" key and then the "ENTER" key at which time the control board resets to the programming mode and the display provides the "PROGRAM" message.

The processor will "power down" after an idle period of approximately 30 seconds into a "sleep mode" for power conservation. The timing of this event is not critical and as will be appreciated by those skilled in the art, any means to achieve power conservation is within the scope of the present invention. The processor can be reactivated by either depressing the "RESET" key, or when the power supply is toggled from off to on (e.g. changing batteries) or by any other variation as desired.

Figure 13A:
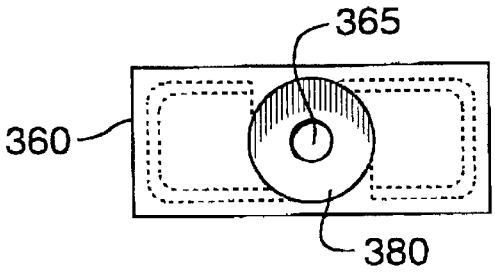
FIG. 13A illustrates a top view of a battery cover of the lock of FIG. 1.
Figure 13B:
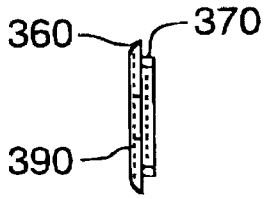
FIG. 13B provides an end view of the battery cover of FIG. 13A.
Figure 14A:
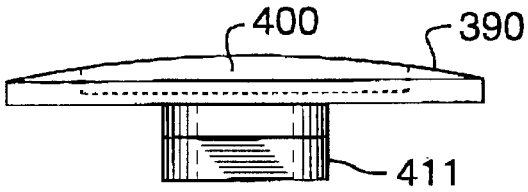
FIG. 14A illustrates a side view of a cover closure for insertion in the battery cover of FIG. 13A.
Figure 14B:
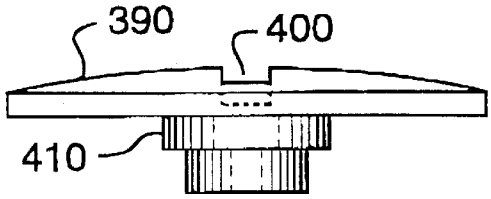
FIG. 14B illustrates another side view of a cover closure for insertion in the battery cover of FIG. 13A.
Figure 15A:
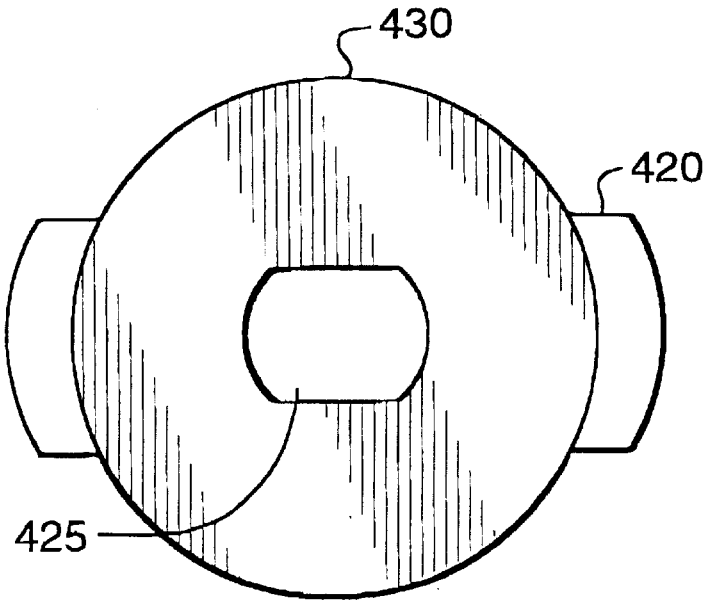
FIG. 15A illustrates a top view of a locking washer for use with the battery cover of FIG. 13A.
Figure 15B:
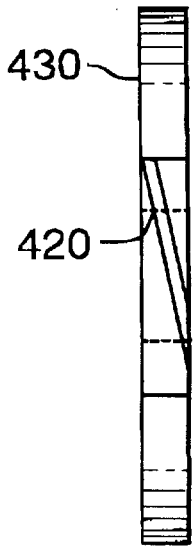
FIG. 15B illustrates a side view of the locking washer of FIG. 15A.

Referring now to FIGS. 13A and B, FIGS. 14A and B and FIGS. 15A and B, illustrated are the lock bottom cover 360 with stylized washer 430 to close the space or battery compartment 110 (FIG. 3A). A stem portion 410 at the battery cover closure disk is placed through a hole 365 in the cover which is shown in FIG. 13A. The disk rests in a counterbore 380 allowing a flush fit and is seen in place in position 390 in FIG. 13B. A shaft extension 411 of the battery cover closure disk supports the stylized washer 430, which is illustrated in FIGS. 15A and B, by fitting into a washer hole 425. This allows rotation of engaging arms 420 so they enter retaining slots 435 of the main body 60 illustrated in FIG. 3A. A slot 400 in the disk facilitates rotation thus locking the cover into position. As will be understood by those skilled in the art, any other suitable means for retaining the battery in place is within the scope of the present invention.

OPERATION OF THE INVENTION

The lock of FIG. 1 in operation provides a programmable microprocessing interface which is capable of user programming. Any one of as many as 99,999,999 different combinations may be entered by the user. When the combination is entered by the use of the keypad 40, an electric signal is sent via the controller module (FIGS. 11 and 12A and B) via the wiring insert (FIGS. 6A, B and C) to the 9-volt battery 500 which is located at the base (FIGS. 1, 17 and 18) of the body of the lock. The motor assembly 510 (FIGS. 17 and 18) then causes the actuating screw 260 to turn which causes the locking wedge 320 to ride down the actuating screw causing the assembly to disengage a set of locking balls 530 from the shackle 20.

With the assistance of a spring and stem mechanism 172 and 170 located in the shackle at space 455, the locking bar opens automatically. The lock uses a sensor switch located at 212 (see FIG. 6A) and at position 107 when assembled in the main body (see FIG. 3A). When the locking bar is depressed to the closed position a pulse is sent from the relocking switch 520 to the motor assembly 510 to engage the locking balls 530 back into the locking bar in the shackle recesses 460 to secure the lock in the closed position and reset the electronic interface to the "ready" position, all as discussed above under the heading programming logic control.

While the invention has been particularly shown and described with reference to preferred embodiments, it will be understood by those skilled in the art that various other changes in form and detail may be made without departing from the spirit and scope of the invention.

We claim:

1. An electronic padlock comprising:

a body;

a keypad on said body;

an electronic control board within said body for receiving an input key sequence from said keypad and for storing a defined keycode;

a shackle receivable at a first end and a second end within said body and having a recess on at least one of said first and second ends;

a locking ball mechanism within said body having a locked position to engage said recess for securing said shackle within said body, and an unlocked position disengaged from said recess for releasing said shackle from said body; and a motor assembly connected and responsive to said electronic control board for moving said locking ball mechanism from said unlocked position to said locked position when said shackle is inserted into said body, and for moving said locking ball mechanism from said locked position to said unlocked position when said electronic control board receives an input key sequence matching said defined keycode.

2. The electronic padlock according to claim 1 wherein said locking ball mechanism comprises:

a wedge having a wide portion and a narrow portion; and at least one ball within said body, said at least one ball being impinged between said wide portion and said recess in said locked position, and residing on said narrow portion in said unlocked position.

3. The electronic padlock according to claim 2 further comprising a wedge-actuator acting between said motor assembly and said wedge, wherein said wedge-actuator engages said wedge at a first position during said movement from said unlocked position to said locked position, and engages said wedge at a second position during said movement from said locked position to said unlocked position and is freely movable between said first position and said second position for allowing said motor assembly to generate sufficient speed to move said wedge.

4. The electronic padlock according to claim 1 further comprising a display screen.

5. The electronic padlock according to claim 1 wherein said keypad comprises an enter-key in communication with said electronic control board for indicating the completion of said input key sequence.

6. The electronic padlock according to claim 1 wherein said electronic control board has a programming state for receiving a user-programmable keycode and for storing said user-programmable keycode as said defined keycode.

7. The electronic padlock according to claim 6 wherein said programming state is initiated when said electronic control board has no keycode stored therein.

8. The electronic padlock according to claim 6 wherein said electronic control board has a verification state for receiving a verification keycode and for matching said verification keycode with said user-programmable keycode before storage of said user-programmable keycode.

9. The electronic padlock according to claim 1 further comprising a sensor for communicating to said electronic control board the insertion of said shackle into said body.

10. An electronic padlock comprising:

a body;

a keypad on said body;

an electronic control board within said body for receiving an input key sequence from said keypad and for storing a defined keycode;

a shackle receivable at a first end and a second end within said body and having a recess on at least one of said first and second ends;

a wedge having a wide portion and a narrow portion, said wedge having a locked position and an unlocked position;

at least one ball within said body, said at least one ball being impinged between said wide portion and said recess in said locked position for retaining said shackle in said body, and residing on said narrow portion in said unlocked position for releasing said shackle from said body; and a motor assembly connected and responsive to said electronic control board for rotating in a forward direction to move said wedge from said unlocked position to said locked position when said shackle is inserted into said body, and for rotating in a reverse direction to move said wedge from said locked position to said unlocked position when said electronic control board receives an input key sequence matching said defined keycode.

11. The electronic padlock according to claim 10 further comprising a wedge-actuator acting between said motor assembly and said wedge, wherein said wedge-actuator engages said wedge at a first position during said movement from said unlocked position to said locked position, and engages said wedge at a second position during said movement from said locked position to said unlocked position and is freely movable between said first position and said second position for allowing said motor assembly to generate sufficient speed to move said wedge.

12. The electronic padlock according to claim 10 further comprising a display screen.

13. The electronic padlock according to claim 10 wherein said keypad comprises an enter-key in communication with said electronic control board for indicating the completion of said input key sequence.

14. The electronic padlock according to claim 10 wherein said electronic control board has a programming state for receiving a user-programmable keycode and for storing said user-programmable keycode as said defined keycode.

15. The electronic padlock according to claim 14 wherein said programming state is initiated when said electronic control board has no keycode stored therein.

16. The electronic padlock according to claim 14 wherein said electronic control board has a verification state for receiving a verification keycode and for matching said verification keycode with said user-programmable keycode before storage of said user-programmable keycode.

17. The electronic padlock according to claim 10 further comprising a sensor for communicating to said electronic control board the insertion of said shackle into said body.

18. An electronic padlock comprising:

a body;

a keypad on said body;

an electronic control board within said body for receiving an input key sequence from said keypad and for storing a defined keycode;

a shackle receivable at a first end and a second end within said body and having a recess at each said first and second end of said shackle;

a wedge having a wide portion and a narrow portion, said wedge having a locked position and an unlocked position;

two balls within said body, said two balls being impinged between said wide portion and said recesses in said locked position for retaining said shackle in said body, and residing on said narrow portion in said unlocked position for releasing said shackle from said body; and a motor assembly connected and responsive to said electronic control board for rotating in a forward direction to move said wedge from said unlocked position to said locked position when said shackle is inserted into said body, and for rotating in a reverse direction to move said wedge from said locked position to said unlocked position when said electronic control board receives an input key sequence matching said defined keycode.

19. The electronic padlock according to claim 18 further comprising a wedge-actuator acting between said motor assembly and said wedge, wherein said wedge-actuator engages said wedge at a first position during said movement from said unlocked position to said locked position, and engages said wedge at a second position during said movement from said locked position to said unlocked position and is freely movable therebetween for allowing said motor assembly to generate sufficient speed to move said wedge.

20. The electronic padlock according to claim 18 wherein said electronic padlock further comprises a display screen.

21. The electronic padlock according to claim 18 wherein said keypad comprises an enter-key in communication with said electronic control board for indicating the completion of said input key sequence.

22. The electronic padlock according to claim 18 wherein said electronic control board has a programming state for receiving a user-programmable keycode and for storing said user-programmable keycode as said defined keycode.

23. The electronic padlock according to claim 22 wherein said programming state is initiated when said electronic control board has no keycode stored therein.

24. The electronic padlock according to claim 22 wherein said electronic control board has a verification state for receiving a verification keycode and for matching said verification keycode with said user-programmable keycode before storage of said user-programmable keycode.

25. The electronic padlock according to claim 18 further comprising a sensor for communicating to said electronic control board the insertion of said shackle into said body.

* * * * *

UNITED STATES PATENT AND TRADEMARK OFFICE

CERTIFICATE OF CORRECTION

PATENT NO. : 6,442,983 B1
DATED : September 3, 2002
INVENTOR(S) : Thomas et al.

It is certified that error appears in the above-identified patent and that said Letters Patent is hereby corrected as shown below:

Title page,
Item [74], delete "Vanophem & Vanophem" and insert -- VanOphem & VanOphem --.

Item [57], ABSTRACT,
Line 1, delete "which" and insert -- that --.
Line 6, delete "which" and insert -- that --.

Column 1,
Line 2, insert -- BACKGROUND OF THE INVENTION --.
Line 10, insert -- DESCRIPTION OF THE RELATED ART --.
Line 11, delete "BACKGROUND OF THE INVENTION".
Line 57, delete "which" and insert -- that --.

Column 2,
Line 30, delete "their ends".
Line 31, delete "which" and insert -- that --.
Line 33, delete "a" and insert -- in --.
Line 42, delete "inwards" and insert -- inward --.
Line 53, delete "which" and insert -- that --.

Column 3,
Line 13, delete "which" and insert -- that --.

Column 4,
Line 13, delete "which" and insert -- that --.
Line 27, delete "SUMMARY OF THE INVENTION" and insert -- BRIEF SUMMARY OF THE INVENTION --.
Lines 38 and 49, delete "which" and insert -- that --.
Line 63, delete "BRIEF DESCRIPTION OF THE DRAWINGS" and insert -- BRIEF DESCRIPTION OF THE SEVERAL VIEWS OF THE DRAWINGS --.

Column 5,
Line 61, delete "DESCRIPTION OF THE INVENTION" and insert -- DETAILED DESCRIPTION OF THE PREFERRED EMBODIMENT --.
Line 63, delete "the".
Line 64, delete "lock" and insert -- a lock 10 --.
Line 64, delete "at 10".

UNITED STATES PATENT AND TRADEMARK OFFICE

CERTIFICATE OF CORRECTION

PATENT NO. : 6,442,983 B1
DATED : September 3, 2002
INVENTOR(S) : Thomas et al.

It is certified that error appears in the above-identified patent and that said Letters Patent is hereby corrected as shown below:

Column 6,
Line 8, delete "a".
Line 12, after "cover" kindly insert the number -- 60 --.
Line 15, kindly delete "This lip may be better seen in FIG. 2B which provides a side view of the front cover of FIG. 2A.".
Line 19, after "body" kindly insert -- 30 --.
Line 19, after "lock" insert -- 10 --.
Line 20, kindly delete "the" and insert -- a --.
Line 34, kindly delete "which" and insert -- that --.
Line 37, kindly delete first occurrence "the" and insert -- a --.
Line 37, kindly delete second occurrence "the" and insert -- a --.
Line 38, kindly delete "the" and insert -- a --.
Line 41, kindly delete "balls" and insert -- ball bearings --.
Line 47, kindly delete "the" and insert -- a --.
Line 53, kindly delete "this" and insert -- the --.
Line 53, after "spring" kindly insert -- 172 --.
Line 61, kindly delete "which" and insert -- that --.

Column 7,
Line 27, kindly delete "which'".
Line 41, kindly delete "which" and insert -- that --.
Line 63, kindly delete "which" and insert -- that --.
Line 66, kindly delete "and" and insert a comma -- , --.

Column 8,
Line 30, kindly delete "which" and insert -- that --.
Line 42, kindly delete "consists of" and insert -- includes --.
Line 53, kindly delete "consists of" and insert -- includes --.

Column 9,
Line 1, after "e.g." kindly insert -- 10 --.
Line 27, kindly delete "then".
Line 67, kindly delete "60" and insert -- 30 --.

UNITED STATES PATENT AND TRADEMARK OFFICE

CERTIFICATE OF CORRECTION

PATENT NO. : 6,442,983 B1
DATED : September 3, 2002
INVENTOR(S) : Thomas et al.

It is certified that error appears in the above-identified patent and that said Letters Patent is hereby corrected as shown below:

Column 10,
Line 2, after "cover" kindly insert -- 60 --.
Line 8, after "lock" kindly insert -- 10 --.
Line 13, after "FIGS. 11" kindly insert a comma -- , --.
Line 13, kindly delete first occurrence "and".
Line 13, after "12A and" kindly insert -- 12 --.
Line 14, kindly delete "(FIGS. 6A, B and C)" and insert -- (FIGS. 6A, 6B and 6C) --.
Line 14, kindly delete "9-volt battery 500 which" and insert -- motor 510 that --.
Line 63, after "claim 1" kindly insert a comma -- , --.

Column 11,
Line 19, after "claim 1" kindly insert a comma -- , --.
Lines 23 and 26, after "claim 6" kindly insert a comma -- , --.

Column 12,
Lines 6 and 10, after "claim 10" insert a comma -- , --.
Lines 14 and 18, after "claim 14" insert a comma -- , --.
Lines 62 and 64, after "claim 18" insert a comma -- , --.

Column 13,
Line 1, after "claim 18" insert a comma -- , --.
Lines 5 and 8, after "claim 22" insert a comma -- , --.

Signed and Sealed this

Twenty-second Day of April, 2003

JAMES E. ROGAN
*Director of the United States Patent and Trademark Office*